United States Patent [19]

Rosenthal et al.

[11] 4,087,932

[45] May 9, 1978

[54] TOY ESCALATOR

[75] Inventors: Janice Susannah Rosenthal; Jurgis Sapkus, both of Manhattan Beach, Calif.

[73] Assignee: Mattel, Inc., Hawthorne, Calif.

[21] Appl. No.: 731,643

[22] Filed: Oct. 12, 1976

[51] Int. Cl.[2] ..... A63H 33/30

[52] U.S. Cl. ..... 46/40; 46/32; 46/116

[58] Field of Search ..... 46/40, 39, 12, 32, 116; 198/321

[56] References Cited

U.S. PATENT DOCUMENTS

| | | | |
|---|---|---|---|
| 457,593 | 8/1891 | Spence | 46/116 |
| 618,810 | 1/1899 | Wood | 46/12 |
| 1,101,034 | 6/1914 | Moscherrosch | 46/40 |
| 1,217,865 | 2/1917 | Harris | 46/40 |
| 1,581,562 | 4/1926 | Bleecker et al. | 46/40 |
| 1,879,845 | 9/1932 | Delich | 46/40 |
| 2,658,602 | 11/1953 | Bonanno et al. | 46/40 X |
| 2,678,717 | 5/1954 | Lucas | 46/40 X |
| 2,774,181 | 12/1956 | Cowen | 46/12 |
| 2,776,522 | 1/1957 | Schramm et al. | 46/39 |
| 2,925,686 | 2/1960 | Metrulis | 46/116 X |
| 3,019,556 | 2/1962 | Frisbie | 46/40 X |
| 3,033,340 | 5/1962 | Coryell | 198/315 |
| 3,699,712 | 10/1972 | Handler et al. | 46/32 X |

FOREIGN PATENT DOCUMENTS

| | | | |
|---|---|---|---|
| 237,954 | 9/1911 | Germany | 198/321 |
| 14,404 of | 1892 | United Kingdom | 46/13 |

*Primary Examiner*—F. Barry Shay

*Attorney, Agent, or Firm*—John G. Mesaros; Max E. Shirk; Stephen L. King

[57] ABSTRACT

A toy escalator for use with a doll, the escalator having an inclined base with side rails along opposite edges thereof and a stair member slidable the length of the base between the rails, the stair member being provided with a doll leg engaging fixture to retain the doll in a substantially upright position during operation of the escalator. Manual means are provided by having a string connected to the stair member, the string being operable through an aperture in the upper end of the base for moving the stair member.

7 Claims, 6 Drawing Figures

TOY ESCALATOR

BACKGROUND OF THE INVENTION

The background of the invention will be set forth in two parts.

Field of the Invention

The present invention pertains generally to the field of toys and more particularly to a toy simulating a department store escalator.

In play situations using dolls, a child receives more enjoyment if a doll is utilized in connection with a real-life environment, such as a three dimensional doll house type structure or the like. In this connection a structure is provided in the form of a department store and a toy escalator is provided to simulate a shopper ascending from the lower level to the upper level of the store or vice versa.

Description of the Prior Art

The prior art known to applicant is listed by way of illustration, but not of limitation, in separate communications to the United States Patent Office.

The present invention exemplifies improvements over this prior art.

SUMMARY OF THE INVENTION

It is the primary object of the present invention to provide a new and useful toy simulating an escalator.

It is another object of this invention to provide a toy escalator, manually operated, having one moving part.

According to the present invention, the toy escalator includes an elongate base having means at one end thereof adapted for engaging a surface of a three dimensional structure or the like, to provide an inclined plane. The base is provided with generally perpendicular side-rails affixed to the edges thereof. At the juncture of the inside surface of the rail with the base a channel is provided substantially the full length of the base. Operable within the opposing channels is a stair member slidably coacting with the base and the channels and a guide rib disposed generally centrally with respect to the length of the base. The stair member is provided with means for engaging the legs of a doll to generally maintain the doll in an upright position during operation of the stair member. A string extending through an aperture in the upper end of the base has one end thereof secured to the stair member to permit movement of the stair member in an upward direction by an operator pulling the string to permit movement of the stair member in an upward direction by an operator pulling the string at the free end thereof. Stop means are provided at the upper end of the escalator base to maintain the stair member against the force of gravity in its upper position.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENT

Figure 1:
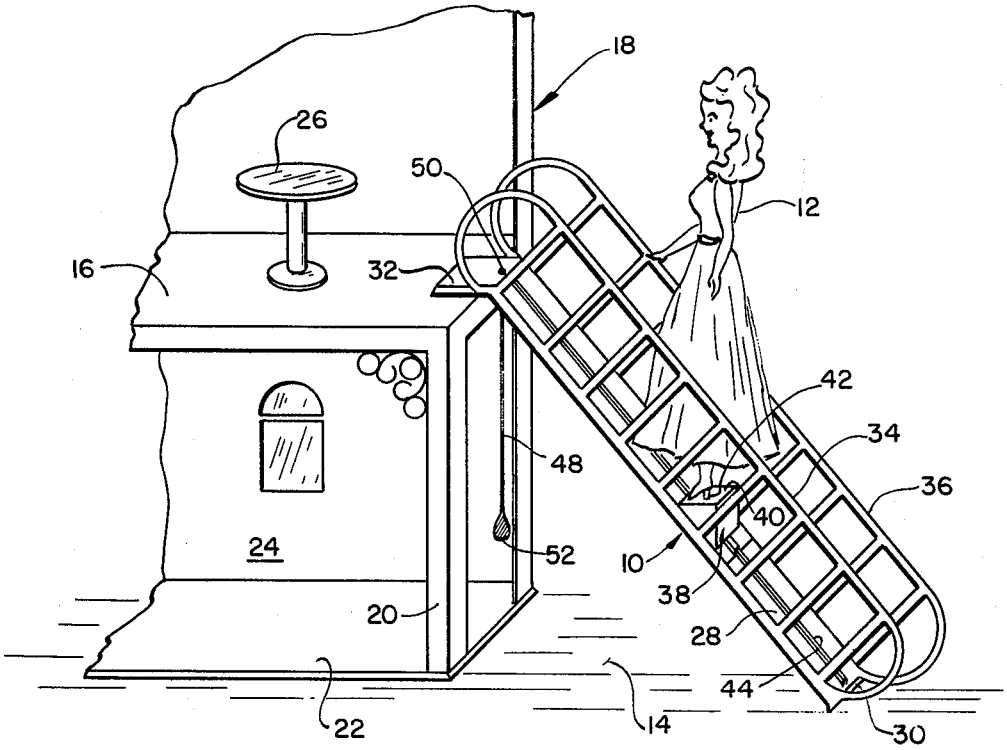
FIG. 1 is a perspective view of the toy escalator according to the invention showing a doll positioned for transport to an upper level of a three dimensional structure.

Referring now to the drawings and more particularly to FIG. 1 there is shown a toy escalator generally designated 10, for transporting a doll 12 between a lower level surface 14 corresponding to a floor or table top or the like and an upper level 16 which could be, for example, the second floor of a simulated three dimensional department store structure generally designated 18.

The structure 18 can be in the form of a doll house, a department store, or any other type simulating a real-life environment where a human being would ordinarily utilize an escalator from a lower to an upper level. However, in the present instance the structure 18 is provided with a vertical partition 20, a floor 22, and a back wall 24 to support the second floor 16, upon which may be any suitable furniture such as a table 20 or the like.

The escalator 10 has an elongated generally rectangular base 28 with the lower end 30 thereof adapted to coact with the surface 14 for supporting the lower end thereof. The upper end of base 28 is provided with an angularly extending projection 32 adapted to rest upon the second floor 16 of the structure 18 thereby providing the inclination necessary for the escalator 10.

Secured to opposite long edges of the base 28 are side rails 34 and 36 extending generally perpendicular to the base 28 of escalator 10, thereby simulating the hand rails of an escalator.

Supporting the doll 12 on the escalator 10 is a stair member 38 slidably coacting with the plane of the base 28. The stair member 38 has a surface 40 so configured to be disposed generally horizontally with the escalator 10 in its inclined operative position. As will be discussed hereinafter the upper surface 40 has a fixture 42 extending upwardly therefrom to engage the legs of the doll 12. The base 28 of the escalator 10 is provided with a longitudinally extending guide rib 44 disposed generally centrally with respect to the length of the base along the direction of travel of the stair member 38, the stair member 38 being provided with a groove to coact with the guide rib 44 to laterally stabilize the stair member 38. The front end of the stair member 38 is provided with an apertured lug 46 (FIG. 2) having secured thereto a string 48 which extends generally along side the guide rib 44 to the upper end of the base 28 where it passes through an aperture 50 and has the free end thereof terminating by securing to a pull tab 52. Thus a child utilizing the toy, pulls downwardly on the pull tab 52 to thereby slide the stair member 38 under control of the guide rib 44 to thereby move the doll 12 upwardly on the escalator 10 (FIG. 1). The doll can operate likewise in a downward direction under force of gravity of the upper position into a lower position. Although the guide means on the base 28 are depicted as being a guide rib 44, it is to be understood that a channel in the base with a corresponding projection on the stair member 38 would accomplish the same purpose.

Figure 2:
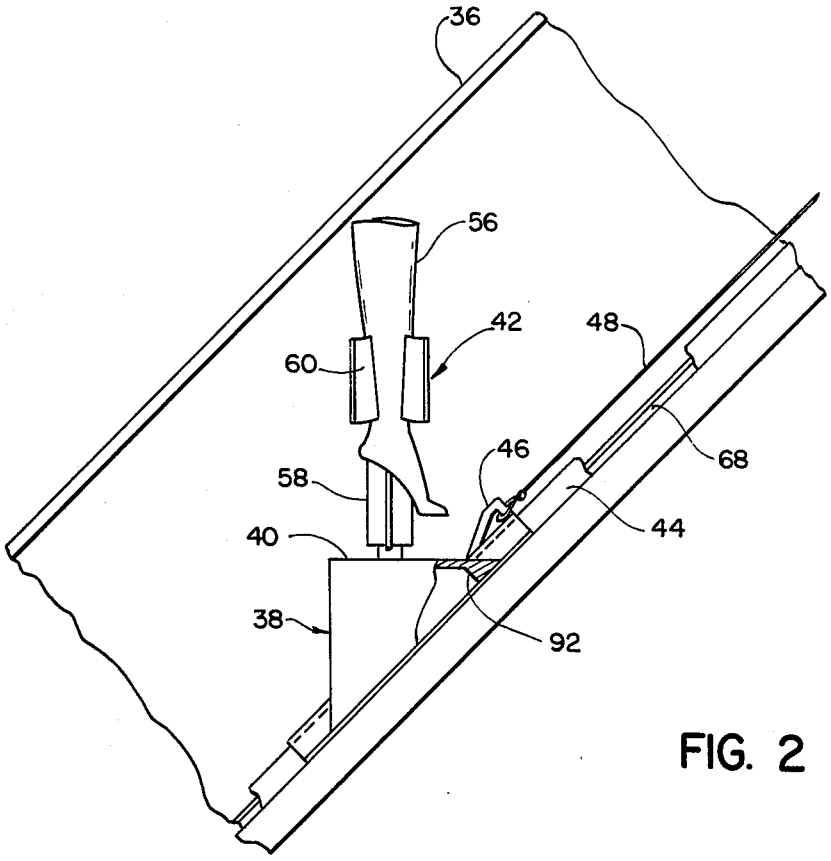
FIG. 2 is an enlarged partial side view of the toy escalator of FIG. 1 with a side rail removed and the stair member partially broken away.
Figure 3:
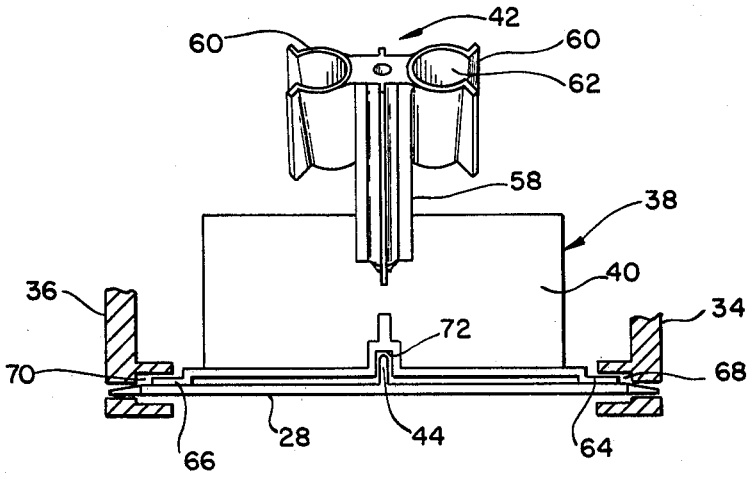
FIG. 3 is an end view of the stair member of FIG. 2 showing the doll leg engaging means.
Figure 4:
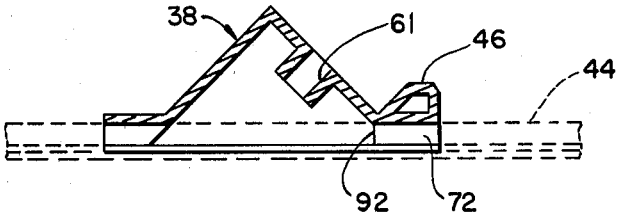
FIG. 4 is a cross sectional side view of the stair member of FIG. 3.

Referring now to FIGS. 2–4, the details pertaining to the stair member 38 will be discussed in detail. As shown in FIG. 2 the legs 56 of the doll 12 are shown engaging a leg engaging fixture 42 which is a one piece assembly (FIG. 3) consisting of a main trunk portion 58 secured to the upper surface 40 of stair member 38 to extend generally perpendicular thereto. The trunk portion 58 is inserted into an aperture 61 (FIG. 4) for frictional retention therein. The upper portion of the fixture 42 is provided with a pair of clasps 60 which have a generally horseshoe shaped cross section with the bight portion thereof being secured to the main trunk portion 58. The doll legs are inserted into the elongated openings 62 of the clasps 60 for frictional retention therein with the feet of the doll 12 in proximity to or resting on the surface 40 of stair member 38.

As shown in FIG. 3 the stair member 38 is provided at the lower porton thereof with a pair of outwardly extending lateral projections 64 and 66 which are generally bar shaped and extend in a common plane for engaging the plane of the base 28 within channels 68 and 70, respectively, of side rails 34 and 36 respectively. In this manner the stair member 38 is guided by means of a slot 72 in the lower central portion thereof (FIG. 4) engaging the guide rib 44 of the base 28 of escalator 10. Additional support is given to the stair member 38 by the engagement of the projections 64 and 66 within the channels 68 and 70 of the side rails 34 and 36. The projections 64 and 66 have the surfaces thereof slidably engaging the adjacent surface of the base 28 while the guide rib 44 engaging the slot 72 provides means for guiding the stair member 38 along the length of the base 28. With this essentially three point engagement of the stair member 38, a doll 12 positioned thereon will travel downwardly along the incline under the force of gravity with the operator being able to control the speed with the pull tab 52.

Figure 5:
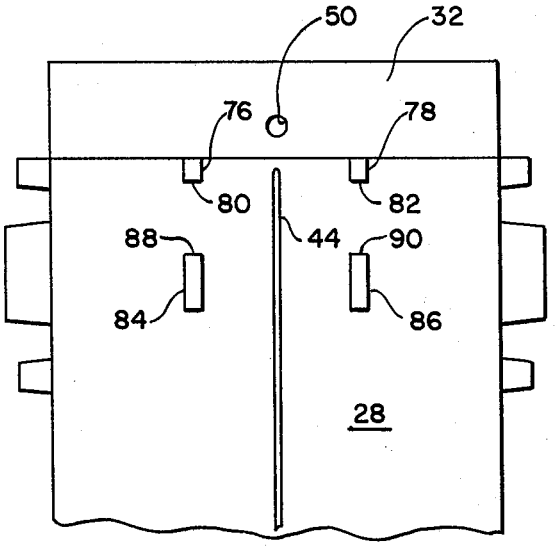
FIG. 5 is a partial plan view of the upper portion of the base of the escalator of FIG. 1.
Figure 6:
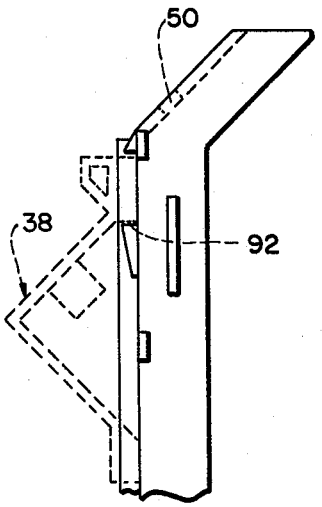
FIG. 6 is a side view of the base portion of FIG. 5.

Referring now FIGS. 5 and 6 the base 28 is shown with the side rails 34 and 36 removed to emphasize details of the upper portion 32 of the base 28. Positioned on either side of guide rib 44 are two pairs of projections, being respectively stop projections 76 and 78 molded into the upper surface of base 28 at the edge of the angular portion 32 of base 28. These stop projections are positioned equidistant on either side of the guide rib 44 and are generally triangularly configured to provide stop edges 80 and 82 to engage the leading corner of the stair member 38 at its uppermost position of travel. Integrally molded into the upper surface of the base 28 are a pair of catch projections 84 and 86 spaced downwardly from the stop projections and generally equidistant of either side of the guide rib 44. The catch projections 84 and 86 are generally triangularly shaped to provide catch edges 88 and 90 which abut against a similarly configured portions 92 on the under surface of the stair member 38 (FIGS. 2 and 4). In this manner as can be seen in FIG. 6 the stair member 38 as it arrives in its uppermost position has the leading edge thereof stopped by abutting against the stop edges 80 and 82 with the catch projections 84 and 86 then engaging portions 92 of stair member 38 to retain it adjacent the upper portion 32 of base 28. The base 28, the stair member 38, and side rails 34 and 36, are so configured to provide a certain amount of play between the projections 64 and 66 of the stair member 38 within the channels 68 and 70. In this manner release of the stair member 38 from the position shown in dotted lines in FIG. 6 is effected by a slight downward and outward push of the stair member 38 to thereby release the stair member 38 and permit the operation thereof under the force of gravity downwardly along the incline.

The details of the aperture 50 are more clearly illustrated in FIGS. 5 and 6, this aperture being the one from which the string 48 is passed at the upper end 32 of the base 28.

Thus it can be seen there has been provided a toy device simulating an escalator whereby a child can play with a doll in a real life type environment by affixing the legs of the doll to a fixture secured to a stair member slidable along a base portion to simulate the movement of a human being along an escalator. While there has been shown and described a preferred embodiment it is to be understood that various other adaptations and modifications may be made within the spirit and scope of the invention.

What is claimed is:

1. In a toy escalator for use with a doll, the combination comprising:

a generally rectangular elongated base having a first end adapted for engaging a generally horizontal first surface and a second end adapted for engaging a second surface at a higher elevation than said first surface to position said base on an incline;

a pair of side members affixed to said base, each of said side members being disposed generally perpendicularly to the plane of the base along opposite edges thereof, each of said side members and said base being generally configured to provide a pair of opposing channels in proximity to the junction of the base with each of said side members;

a stair member slidably engaging said base, said stair member having projecting portions for engaging each of said channels;

means on said stair member adapted for engaging the doll to retain the doll in a generally upright position with said base on an incline; and manually operable means coacting with said stair member and said second end of said base for controlling the movement of said stair member along said base.

2. The combination according to claim 1 further including guide means on said base along the length thereof, said stair member being configured for mating engagement with said guide means.

3. The combination according to claim 2 wherein said guide means on said base is a longitudinally extending centrally disposed rib and the mating means on said stair member is a slot on the under surface thereof coacting with said rib.

4. The combination according to claim 1 wherein said manually operable means consist of a string secured to the upper end of said stair member, said string passing through an aperture in said second end of said base, said string having the free end thereof connected to a pull tab.

5. The combination according to claim 1 further including means integral with said base adjacent said second end for frictionally engaging the under surface of said stair member.

6. The combination according to claim 4 wherein said doll engaging means includes a main trunk portion and a pair of opposing clasps for engaging the legs of a doll.

7. The combination according to claim 6 further including stop means adjacent the upper end of said base for frictionally engaging said stair member.

* * * * *